United States Patent [19]

Tanaka et al.

[11] 4,072,004

[45] Feb. 7, 1978

[54] SWITCHING CONSTRUCTION FOR A HANDY ELECTRONIC DEVICE

[75] Inventors: Kojiro Tanaka, Yachiyo; Kenjiro Yagi, Tokyo, both of Japan

[73] Assignee: Kabushiki Kaisha Daini Seikosha, Japan

[21] Appl. No.: 657,312

[22] Filed: Feb. 11, 1976

[30] Foreign Application Priority Data

Feb. 14, 1975 Japan ..... 50-19230

[51] Int. Cl.[2] ..... G04C 3/00

[52] U.S. Cl. ..... 58/23 R; 58/55; 58/90 R; 200/159 B

[58] Field of Search ..... 200/5 A, 5 R, 264, 159 B; 58/50 R; 500/23 R, 23 BA, 35, 90 R

[56] References Cited

U.S. PATENT DOCUMENTS

| | | | |
|---|---|---|---|
| 2,862,382 | 1/1975 | Glaister et al. | 200/5 R |
| 3,803,834 | 4/1974 | Reese | 58/50 R |
| 3,860,771 | 1/1975 | Lynn et al. | 200/5 R |

*Primary Examiner*—Jr. Smith

*Attorney, Agent, or Firm*—Robert E. Burns; Emmanuel J. Lobato; Bruce L. Adams

[57] ABSTRACT

An electronic timepiece comprises a digital display device and electronic circuitry including a printed circuit board containing thereon a pattern of printed conductors connected to drive the digital display device. A cover member is disposed atop the timepiece casing and on a side portion of the cover member are mounted a plurality of depressable key switches, the key switches being mounted at a location overlying and spaced from the pattern of printed conductors. An electro-conductive rubber sheetlike member coacts with the cover member for both sealing in a water proof manner the region between the cover member and the timepiece casing and effecting electrical connection between individual ones of the key switches and the pattern of printed conductors in response to depression or actuation of the key switches.

4 Claims, 4 Drawing Figures

FIG. 1
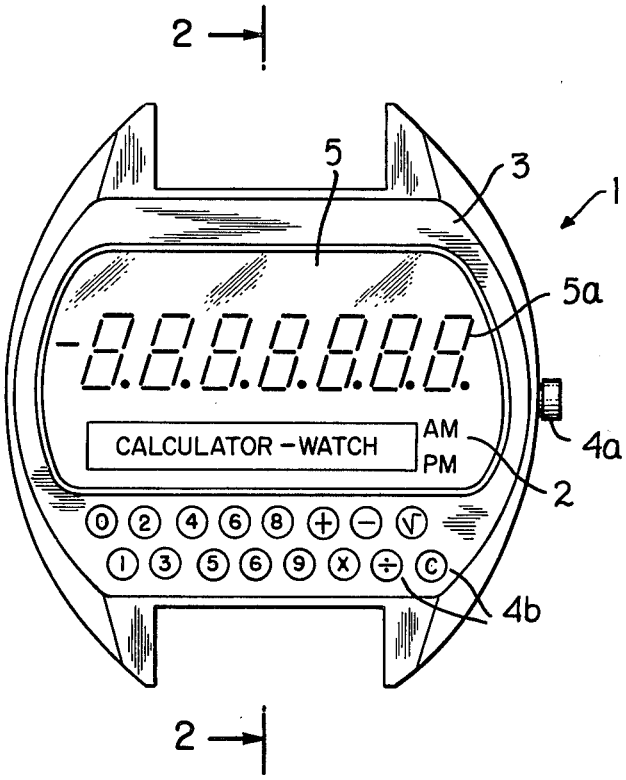
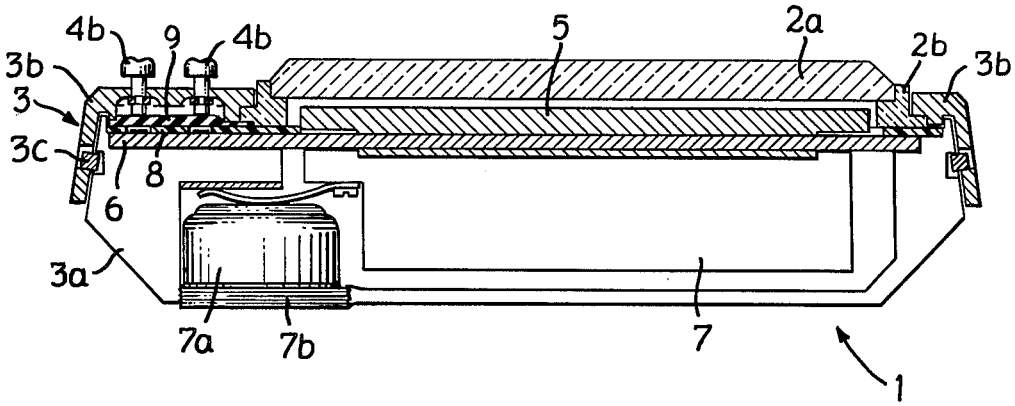
FIG. 2

FIG. 3
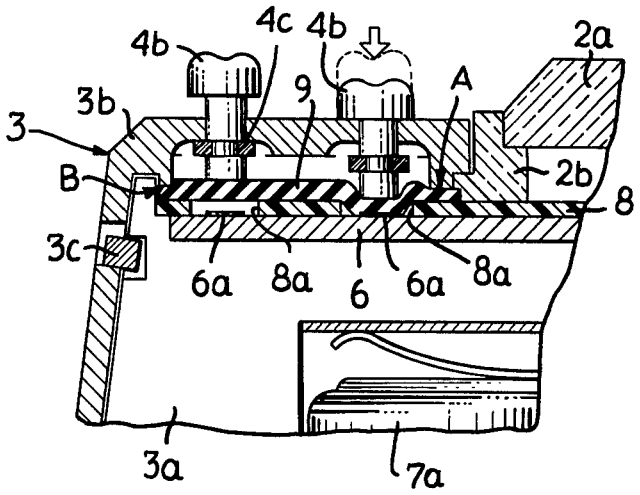
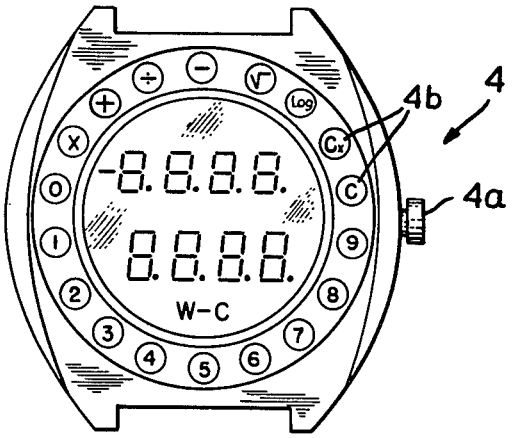
FIG. 4

SWITCHING CONSTRUCTION FOR A HANDY ELECTRONIC DEVICE

BACKGROUND OF THE INVENTION

This invention relates to the switching construction for an electronic device specially designed for increasing the reliability of the water proof characteristics of the input switch portion by the employment of electro conductive rubber for the water proof packing member.

It is possible to make a portable and handy electronic device, for example an electronic calculator, due to the remarkable development of the electronic technic especially the integrated circuit and the manufacturing technic for the display device whereby it is possible to combine the electronic calculator in a wristwatch.

It is very useful to construct the calculator and the digital electronic wristwatch in one casing as one body, however, such a combination creates new problems. Namely it is necessary to have severe water proof characteristics for the wristwatch, and it is necessary to provide many input switches for the calculator, however, it is not preferable for the water proof characteristics to provide many switches for the wristwatch, because it is necessary to provide many through holes to the casing of the wristwatch.

In the conventional type of wristwatch-calculator assembly, the water proof characteristics for sealing the switches in the wristwatch comprises a generally ring shaped rubber packing member associated with each switch. However it is not so preferable to employ said rubber packing member for said switches from the standpoint of cost and from the standpoint of overall wristwatch size. Further the reliability of the wristwatch becomes lower by the need for many water proof portions.

SUMMARY OF THE INVENTION

This invention aims to eliminate the above noted difficulty of the water proof construction in the switching portion of the conventional type wristwatch-calculator assembly and therefore the principle object of the present invention is to provide a common electrode composed of electro-conductive rubber sheet for the switches as the water proof packing member.

BRIEF DESCRIPTION OF THE DRAWINGS

FIG. 1 shows a flat plan view of a wristwatch-calculator assembly according to the present invention, FIG. 2 shows a cross-sectional view thereof, FIG. 3 shows an enlarged cross-sectional view of the switching section shown in FIG. 2, and FIG. 4 shows a flat plan view of another embodiment of wristwatch-calculator assembly according to the present invention.

DESCRIPTION OF PREFERRED EMBODIMENTS

FIG. 1 shows the flat plan view of the electronic device equipped with an electronic calculator, for example, a wristwatch 1 having the electronic calculator. Said wristwatch 1 is composed of a glass panel 2, the casing 3 mounted on a electronic circuit 7 of the watch being disposed in the inner cavity defined by said glass 2 and casing 3. A set of externally-actuatable operating members 4 are mounted to said casing 3, and a digital display device 5 composed of a plurality of display elements 5*a* is disposed beneath the glass panel 2. Said set of external or outer operating members 4 is composed of a switching member 4*a* for switching the electronic circuit and the display contents to the desired function, for example the watch function or the calculating function, and a series key switches 4*b* for operating the input signals for using the electronic calculator. The water proof characteristics are especially needed for the switching members disposed in a flat shaped construction as indicated in FIG. 1.

FIG. 2 shows the cross sectional view of II—II line in FIG. 1. The printed circuit board 6 is electrically connected to the electronic circuitry 7 and the display device 5 is mounted in a recess portion of the casing body 3*a* of the casing 3 and an electro conductive rubber member 9 is mounted on said printed circuit board 6 via an insulating member 8. The glass member 2 comprises a glass portion 2*a* and a glass bezel 2*b* mounted to said casing 3, the cover member 3*b* having a plurality of depressable key switches 4*b* mounted thereon. A spring member 3*c* in the form of a ring is attached to the side channel portion of the casing body 3*a* thereby completing the assemblage. A small battery 7*a* as the power source is housed in a battery housing portion which is closed by a cover member 7*b* threaded to the casing body 3*a*.

FIG. 3 is the enlarged partial cross sectional view for explaining the detailed construction. It is possible to completely separate and seal the region between the interior of the casing body 3*a* which houses the electronic circuit 7 and display device 5 and the casing exterior by said electro conductive rubber member 9 which is mounted and retained in place by the printed circuit board 6 and projecting portions A and B of the cover member 3*b* via said insulating member 8. Namely, the gap area between said glass bezel 2*b* and said cover member 3*b* is completely sealed by the pressing force exerted on the rubber member 9 by the cover member portion A and the gap area between said casing body 3*a* and said cover member 3*b* is completely sealed by the pressing force exerted on the rubber member by the cover member portion B. An E-shaped ring member 4*c* functions as the stopper for each key switch 4*b* and is very useful in achieving the water proof effect.

Referring now to the operation of the present invention:

Upon depression of said key switches 4*b*, said electro conductive rubber member 9 is flexed into contact with the printed conductor 6*a* on the printed circuit board 6 via the hole portion 8*a* formed in the insulating member 8 whereby the ON and OFF operations are attained. Therefore, said electro conductive rubber member 9 assumes a plus potential via the route of the plus side of the battery, the battery cover 7*b*, the case body 3*a* and the cover member 3*b* whereby the plus-potential is applied to the preferable printed conductor 6*a* by the pushing operation of said key switch 4*b*. Said key switches are positioned in accordance with the requirements of the calculating circuit and the time counting circuit, and are disposed under the display device 5 at equal intervals as indicated in FIG. 1. Further it is possible to dispose the key switches in a circular shape as indicated in FIG. 4.

According to the present invention, the water proofness of the electronic device having many switches is attained by the use of the electro conductive rubber member functioning as the common electrode and the water proof packing member whereby it is possible to attain the high reliability and the lower cost for the wristwatch having the calculating function.

We claim:

1. In an electronic timepiece of the type having a digital display device, and electronic circuitry including a printed circuit board having a pattern of printed conductors thereon connected to drive said digital display device: a timepiece casing having said digital display device and electronic circuitry mounted therein; a cover member disposed atop and connected to said timepiece casing; a plurality of depressable key switches mounted on a portion of said cover member at a location overlying and spaced from said pattern of printed conductors; and means coacting with said cover member for both sealing in a water proof manner the region between the cover member interior and the timepiece casing interior and effecting electrical connection between individual ones of said key switches and said pattern of printed conductors when said key switches are depressed.

2. An electronic timepiece according to claim 1; wherein said means comprises a flexible electro-conductive rubber member interposed between said portion of said cover member and said printed circuit board and being spaced from said printed conductors so that depression of said key switches effects resilient flexing of said electro-conductive rubber member into contact with said printed conductors.

3. An electronic timepiece according to claim 2; wherein said cover member includes projecting portions engaging with and pressing said electro-conductive rubber member into engagement with said printed circuit board to form said water proof seal.

4. An electronic timepiece according to claim 3; further including an electrically insulative member sandwiched between said electro-conductive rubber member and said printed circuit board thereby maintaining said rubber member spaced from said printed conductors and having holes therein at locations aligned with said key switches to enable flexing of said rubber member into contact with said printed conductors in response to depression of said key switches.

* * * * *